US006817307B2

(12) United States Patent
Gerster

(10) Patent No.: US 6,817,307 B2
(45) Date of Patent: Nov. 16, 2004

(54) TEXTILE TRIM WITH DECORATIVE DOUBLE LIPPED FASTENING STRUCTURE

(75) Inventor: Martin Gerster, Biberach/Riss (DE)

(73) Assignee: Brimar, Inc., Lake Forest, IL (US)

( * ) Notice: Subject to any disclaimer, the term of this patent is extended or adjusted under 35 U.S.C. 154(b) by 49 days.

(21) Appl. No.: 10/229,816

(22) Filed: Aug. 28, 2002

(65) Prior Publication Data

US 2004/0040484 A1 Mar. 4, 2004

(51) Int. Cl.[7] ..... B32B 7/08; D05C 17/02
(52) U.S. Cl. ..... 112/475.08; 112/409; 223/46
(58) Field of Search ..... 112/400, 406, 112/425.08, 409, 408, 410, 415, 416, 420.22; 223/44, 46; 28/145, 147; D02/811

(56) References Cited

U.S. PATENT DOCUMENTS

| | | | | | |
|---|---|---|---|---|---|
| 660,663 | A | * | 10/1900 | Stoekley | 112/409 |
| 849,693 | A | * | 4/1907 | Morley | 112/409 |
| 1,953,522 | A | * | 4/1934 | Weis | 112/410 |
| 2,398,645 | A | * | 4/1946 | Kahn | 112/409 |
| 2,646,671 | A | * | 7/1953 | Newman | 112/409 |
| 3,395,738 | A | * | 8/1968 | Rhodes | 139/385 |
| 3,889,616 | A | | 6/1975 | Passons | |
| 4,517,233 | A | | 5/1985 | Weichman | |
| 4,524,706 | A | | 6/1985 | Bell | |
| 4,691,537 | A | | 9/1987 | Cullen | |
| 4,744,317 | A | | 5/1988 | Cullen | |
| 4,780,351 | A | | 10/1988 | Czempoyesh | |
| 4,824,703 | A | | 4/1989 | Bernard | |
| 5,389,421 | A | | 2/1995 | Pearlman | |
| RE36,636 | E | | 4/2000 | Sturm | |
| 6,143,397 | A | | 11/2000 | Kanehara | |

* cited by examiner

*Primary Examiner*—Ismael Izaguirre
(74) *Attorney, Agent, or Firm*—Meroni & Meroni, P.C.; Charles F. Meroni; Paul Derek Pressley

(57) ABSTRACT

Trim with decorative double lipped fastening structure comprising a first set of threads folded near a midpoint and knotted together providing a knot near a midpoint of the threads with a fringe end and a folded end on opposite sides of the knot. A second set of threads adjacent the first set of threads is similarly folded and knotted. A lip is provided by a cross stitching connecting the folded ends of the first and second set of threads side by side. A second lip of thread having a plurality of folds folded to length equal to the length of the folded ends of the first and second set of threads are held together by a cross stitching. An end of the second lip is fastened adjacent the first and second knots by a cross stitching providing a bottom of a fastening channel of uniform depth.

25 Claims, 8 Drawing Sheets

TEXTILE TRIM WITH DECORATIVE DOUBLE LIPPED FASTENING STRUCTURE

BACKGROUND OF THE INVENTION

1. Field of the Invention

The present invention relates to decorative trim and more specifically relates to textile trim with a decorative double lipped fastening structure.

2. Description of the Prior Art

Different types of decorative fringe trim for decorating objects such as rugs, pillows, blankets and other similar items have been in use for over a thousand years. The structure of the portion of the trim used to fasten the trim to another object such as a piece of material has changed very little over time, consisting typically of a single lipped fastening structure for fastening the trim to a single face of an item. Therefore, it is necessary when using trim of this type to separately fasten a separate piece of decorative trim to the opposite face of the item if a uniform appearance is desired. This additional work in creating an aesthetically appealing finished product requires a great amount of time and skill to affix the trim to an item properly. Decorative trim of this type has to be aligned with the item to which it is being fastened requiring preparation time and equipment that maintains the alignment. An example of this type of decorative trim is U.S. Pat. No. 3,889,616 issued to Passons. The Passons patent discloses a tufted fringe product and a process of making the same. The product has an elongated flexible tape through which a plurality of yarns are stitched to form longitudinally spaced fringe tufts projecting from one face of the tape.

In order to reduce the amount of time and complication in securing trim pieces to other objects, several channel shaped fastening structures have been developed that fasten about the edge of a piece of material so as to provide trim that covers two faces of a piece of material. Some of these channel shaped structures are described here.

U.S. Pat. No. 4,517,233 issued to Weichman discloses a channel-shaped two-wire carrier that is coated with elastomeric material to form an edge protector trim strip. A plurality of strands of material extending longitudinally of the carrier is interwoven with the support and reinforcing wires to maintain spaced relation.

U.S. Pat. No. 4,780,351 issued to Czempoyesh discloses a device for containing the force of an explosion comprising a blanket or curtain of flexible material. The fabrics are bound together at their edges with a border of tough material extending around the periphery of the blanket or curtain. However, this prior art reference does not disclose the channel shaped connection structure being constructed of woven material that integrally forms the tufted trim.

U.S. Pat. No. 6,143,397 issued to Kanehara discloses an opening trim including a body approximately U-shaped in section. Each of the holding projections has a primary lip projecting rearward from a front portion of an inner side surface of the body.

However, many of these channel shaped fastening structures have been developed for different applications and therefore do not address issues associated with providing a decorative trim. More specifically, the prior art does not disclose a double lipped decorative trim presenting a similar woven appearance on either side of the material to which the trim is attached. Therefore, there is a need for a textile trim with a decorative double lipped fastening structure.

SUMMARY OF THE INVENTION

In order to create an item such as a blanket, pillow, or drapery with a tasseled fringe having similar decorative connecting structure on opposite faces of the item, makers of the item in the past would have to first attach a single lipped fringe onto one face of the item and then place a second decorative panel on the opposite face of the item so that both faces presented a uniform appearance. The claimed invention provides a textile trim with a decorative double lipped fastening structure reducing the number of steps involved in creating an item having a tasseled fringe with similar decorative connecting structure on opposite faces of the item.

An object of the claimed invention is to provide a decorative trim that is quickly and easily attachable to a piece of material without need for alignment with the item of which it is to be attached.

Another object of the claimed invention is to provide a decorative trim with a decorative woven lip on two faces of an item of which the trim is to be attached.

A further object of the claimed invention is to provide a one piece double lipped decorative trim.

An even further object of the claimed invention is to reduce the number of step required to create an item with a tasseled fringe having similar decorative connecting structure on opposite faces of an item.

To achieve the foregoing objectives as well as others that will become apparent after the reading of the detailed description of the preferred embodiment and viewing the appended drawings a double lipped decorative fringe is provided. The claimed invention provides a decorative trim with decorative double lipped fastening structure comprising a first set of threads folded near a midpoint and knotted together forming a knot near a midpoint of the threads with a fringe end and a folded end on opposite sides of the knot. A second set of threads adjacent the first set of threads is similarly folded and knotted. A lip is formed by a cross stitching connecting the folded ends of the first and second set of threads side by side. A second lip of thread having a plurality of folds folded to length equal to the length of the folded ends of the first and second set of threads are held together by a cross stitching. An end of the second lip is fastened adjacent the first and second knots by a cross stitching forming a bottom of a fastening channel of uniform depth.

The claimed invention also provides a method making a decorative fringe have a double lipped connecting structure. The method comprises first cutting lengths of thread to a predetermined length within a predetermined tolerance. The threads are then arranged with at least one first length of thread along side at least one second length of thread so that a long axis of the first length is substantially parallel with a long axis of the second length. The folding first and second lengths are folded at a common predetermined point forming a folded end and a fringe end so that portions of the lengths on each side of the fold are parallel with each other. The first and second lengths are the knotted into a tuft where the folded end and the fringe end are on opposite side of the knot. The knotted tufts are then arranged side by side and connected together. The outer ends of the folded ends are then secured preventing unraveling of the tufts.

At least one third length of thread is folded to a predetermined folded length a plurality of times so that the folded lengths lie side by side. The folded lengths are then stitched together with a cross stitch forming a textile lip. The edge of the textile lip is then fastened to the folded ends.

BRIEF DESCRIPTION OF THE DRAWINGS

FIG. 1 shows a front view of the double lipped decorative trim.

FIG. 2 shows a side view of the double lipped decorative trim.

FIG. 3 shows a perspective view of the double lipped decorative trim.

FIG. 4 shows placement of a piece of material between the two decorative lips.

FIG. 5 shows the double lipped decorative trim fastened to a piece of material.

FIG. 6 shows an alternate embodiment of the double lipped decorative trim.

FIG. 7 shows the alternate embodiment trim being manufactured on an automatic crocheting machine.

FIG. 8 shows the alternate embodiment trim being simultaneously manufactured with the attached lip on an automatic crocheting machine.

FIG. 9 shows the attached lip being sewn to the decorative lip forming the double lipped decorative trim.

DETAILED DESCRIPTION OF THE PREFERRED EMBODIMENT

Figure 2:
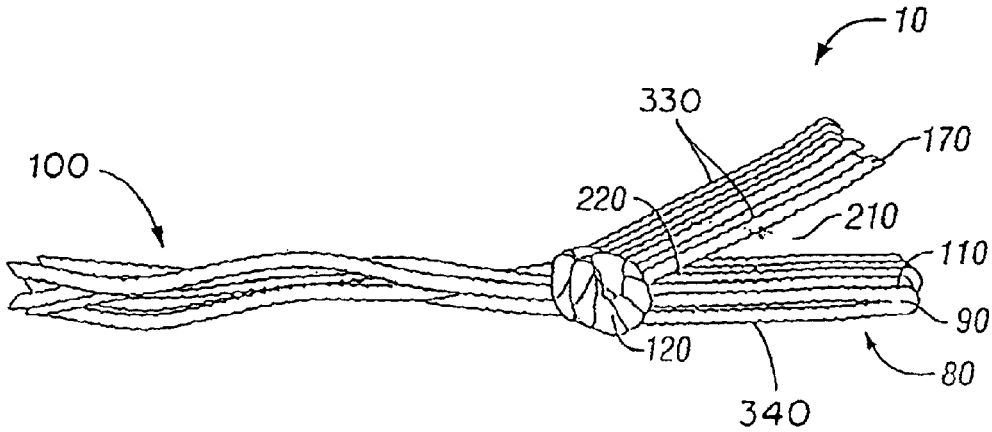
FIG. 2.
Figure 3:
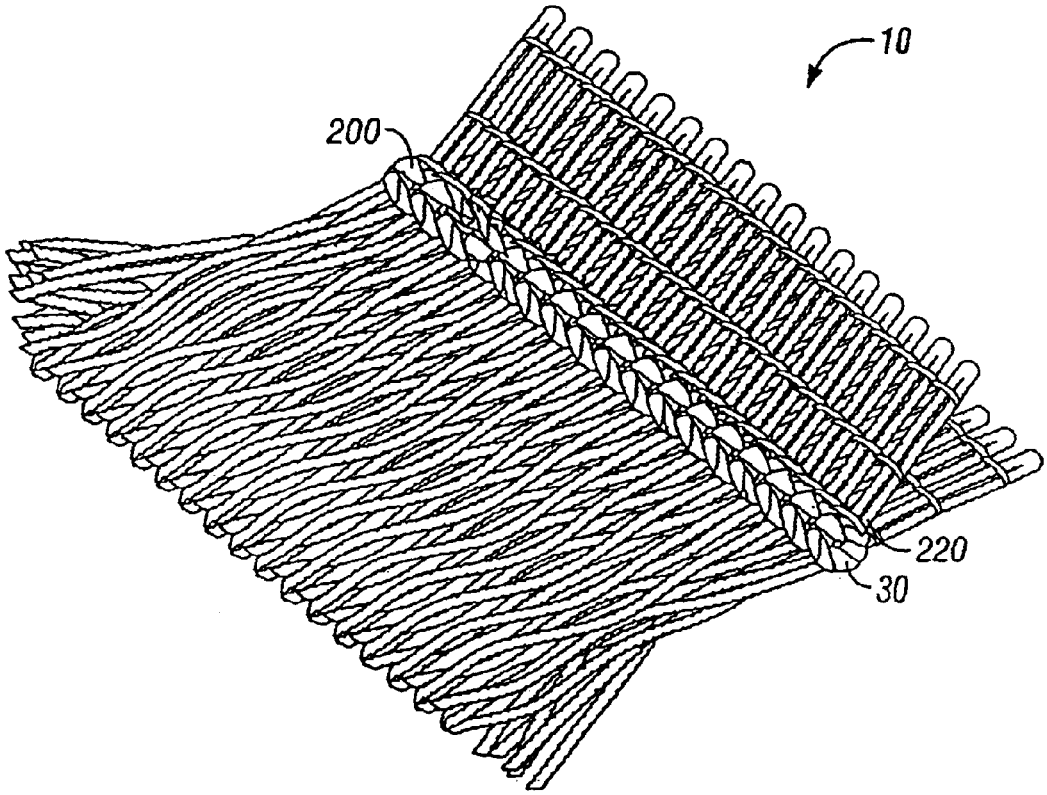
FIG. 3.
Figure 4:
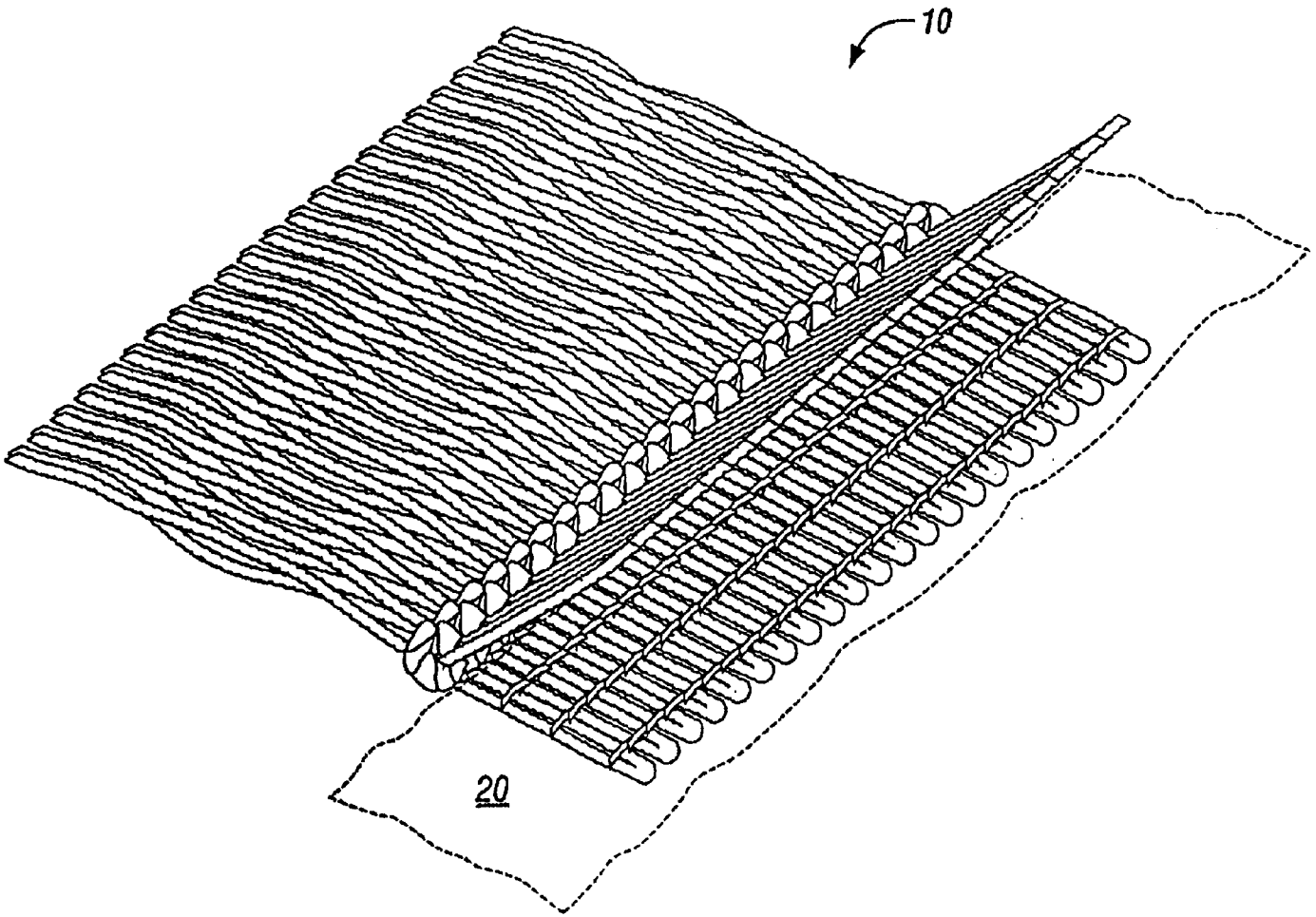
FIG. 4.
Figure 5:
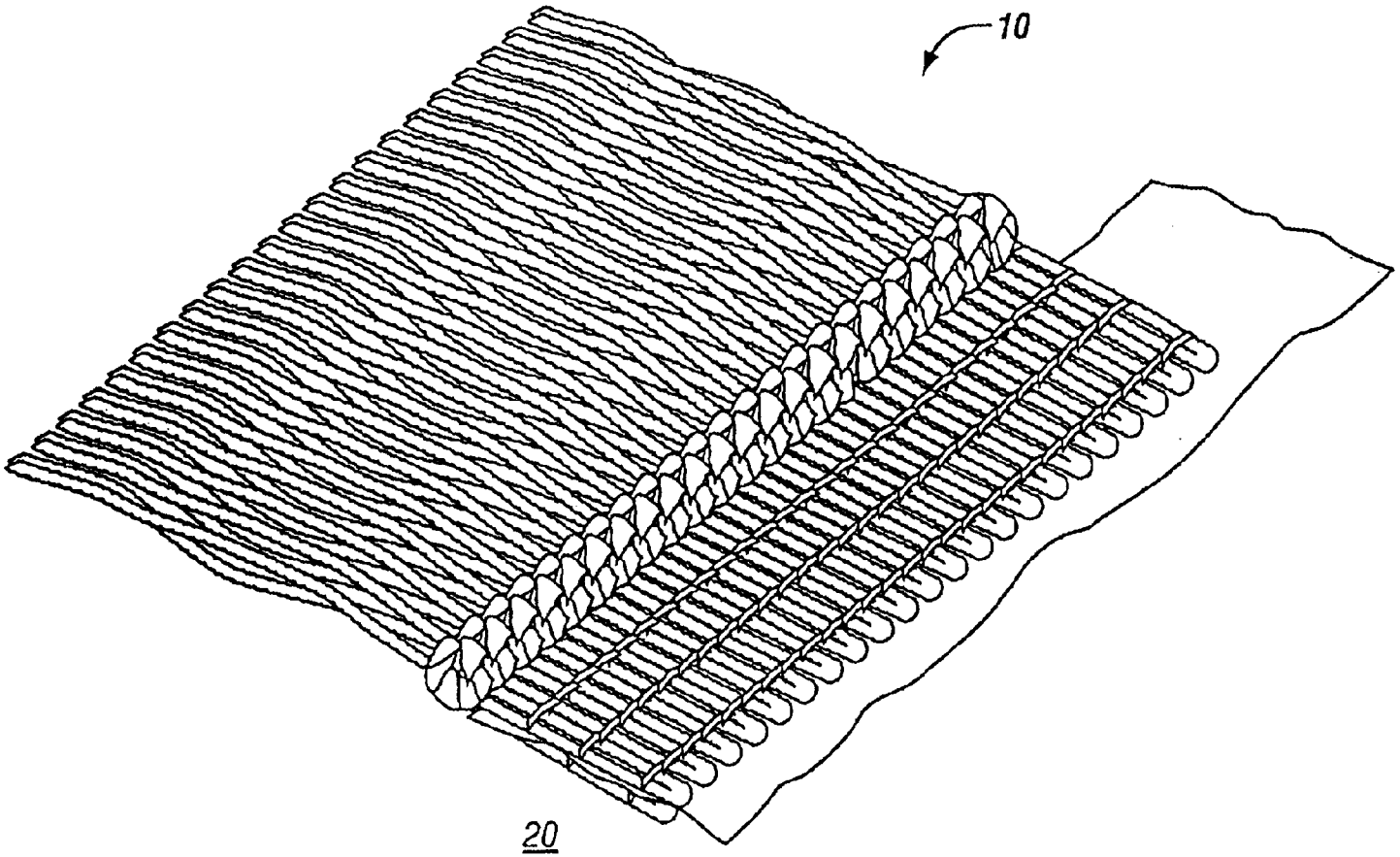
FIG. 5.

The textile trim with decorative double lipped fastening structure 10 is shown in FIGS. 1–5. The double lipped fastening structure allows the trim 10 to be quickly and easily connected to the edge of a piece of fabric 20 while presenting a finished connection between the trim 10 and the fabric 20 on opposite faces of the fabric as shown in FIGS. 4 and 5. The trim 10 generally comprises a knotted tuft 30 having a decorative lip 40 and an attached decorative lip 50.

The knotted tuft 30 shown in FIG. 2 is made up of a plurality of threads 60. The threads 60 used in a knotted tuft 30 of the claimed invention can be of the same type and color, or the threads can be of different types and/or colors depending upon the application. The first knotted tuft 30 is made by first arranging the plurality of threads 60 in parallel along their length. Approximately half of the threads 60 are then folded into a first grouping 80 approximately at the midpoint of the threads so as to be nested one thread inside of another with the shafts of the threads 60 lying side by side forming a relatively flat braid. The folding of the threads 60 creates a folded end 90 and a fringed end 100. The remaining threads are then similarly folded into a second grouping 110. The first 80 and second grouping 110 are then aligned side by side with the folded ends 90 adjacent each other and the fringed ends 100 adjacent each other. The first 80 and second groupings 110 are then knotted together at a point mid way between the folded ends 90 and the fringed ends 100. The knot 120 is knotted such that the threads 60 making the first 80 and second groupings 110 are readily visible within the knot 120. This allows the color of each of the threads 60 to be seen increasing the aesthetic presentation of the knotted tuft 30.

A plurality of knotted tufts 130 can be assembled side by side with the folded ends 90 of each of the knotted tufts 30, 130 being aligned to form the edge 140 of the decorative lip 40 as shown in FIGS. 1, 3–5. The plurality of knotted tufts 130 are stitched together by a cross stitching 150 placed above the knot 120 running generally perpendicular to the lengths of the knotted tufts 30, 130. Preferably, a plurality of cross stitches 150 made of monofilament stitching are used to create the decorative lip 40 so that the folded ends 90 of each of the knotted tufts 30, 130 act together to form the lip 40. However threads of different colors can also be used to stitch the knotted tufts together.

The attached decorative lip 50 is made similar to what is known as a gimp type of decorative trim. However, the attached lip 50 differs structurally in that it does not require the same type of cross stitching that a gimp type trim requires due to the fact that the attached lip 50 is designed to be stitched to the decorative lip 40 before use as shown in FIGS. 1 and 3–5. The attached decorative lip 50 is preferably made so that the appearance of the attached lip 50 matches the appearance of the decorative lip 40 created by the folded ends 90 of the knotted tufts 30, 130 creating a uniform appearance between the decorative lip 40 and the attached lip 50 so that the trim 10 presents an aesthetically pleasing appearance when connected to an item as shown in FIG. 5. The attached decorative lip 50 is made up of a plurality of threads 170. The threads 170 used in the attached lip are preferably of the same type and color as the threads 60 used in the knotted tufts 30, 130, but may be of differing type and/or color depending upon the desired application of the trim 10.

Figure 1:
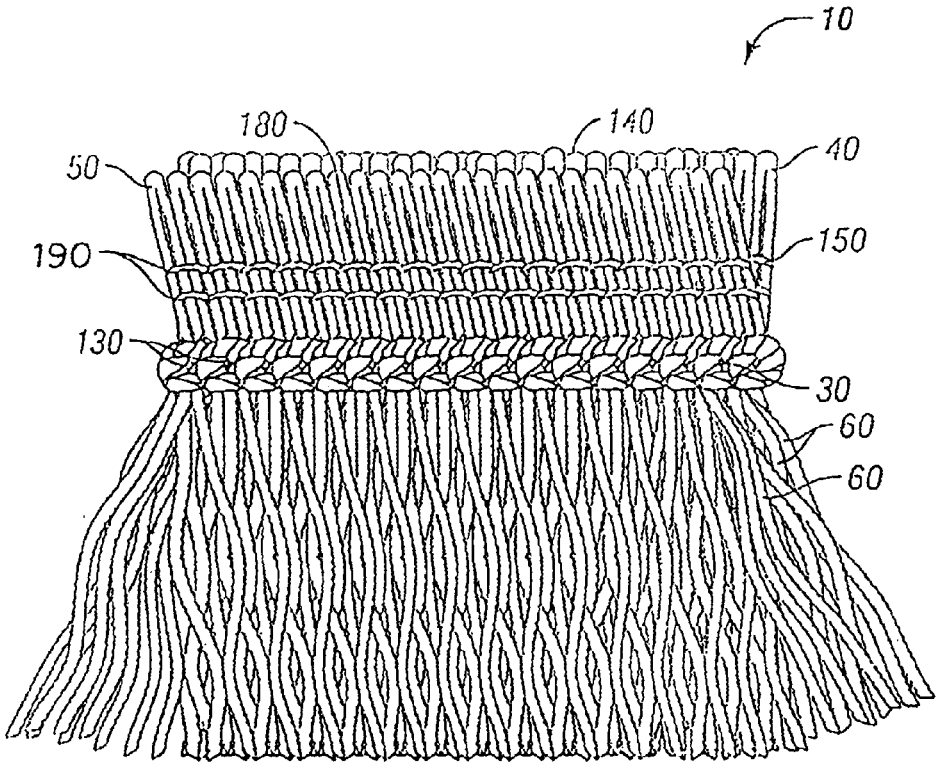
FIG. 1.

The threads 170 that make up the attached lip 50 are first arranged in parallel along their length. The threads 170 are then folded so that one thread is nested inside another with the shafts of the threads 170 lying side by side forming a relatively flat braid. The threads 170 are then repeatedly folded with the shafts of the threads 170 lying roughly parallel and side by side as shown in FIGS. 1 and 3. The distance between each fold is determined by matching the overall length of the attached lip 50 with the length of the decorative lip 40 formed by the folded ends 90 of the knotted tuft 30. The folds 180 of the attached lip 50 are then stitched together to form a discrete relatively flat panel. Preferably, a plurality of cross stitches 190 made of monofilament thread are used to create the attached lip.

Figure 9:
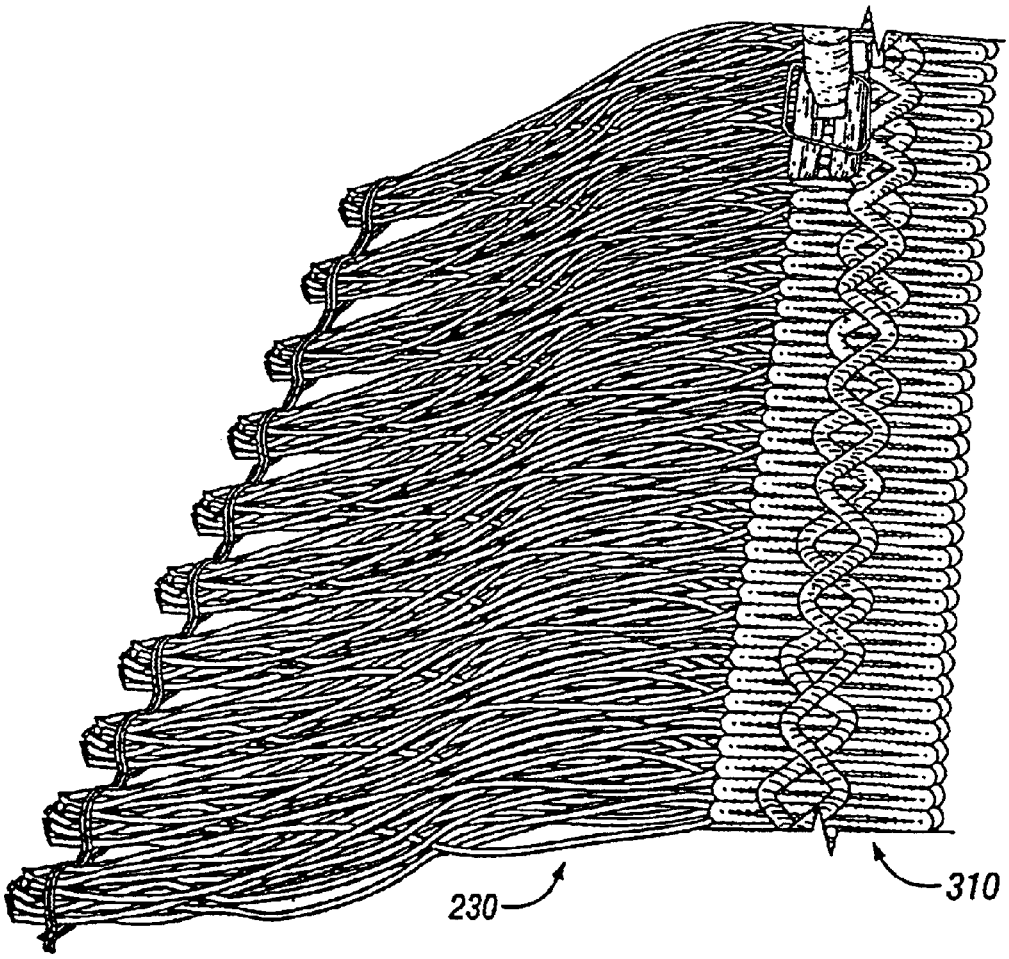
FIG. 9.

A Pfaff brand sewing machine having model number 463 900 57 is preferably used to stitch the attached lip 50 to the knotted tufts 30, 130 just above the knots 120 of the knotted tufts 30, 130 by a cross stitching 200 that form the bottom of a generally U shaped connection channel or pocket 210 as shown in FIG. 9. The cross stitching 200 connecting the attached lip 50 to the knotted tufts 30, 130 creates a uniform stopping point 220 for material 20 being inserted between the decorative lip 40 and the attached lip 50 so that the lips extend over the material 20 to substantially equal distances creating an aesthetically pleasing connection between the trim 10 and the material 20.

Figure 6:
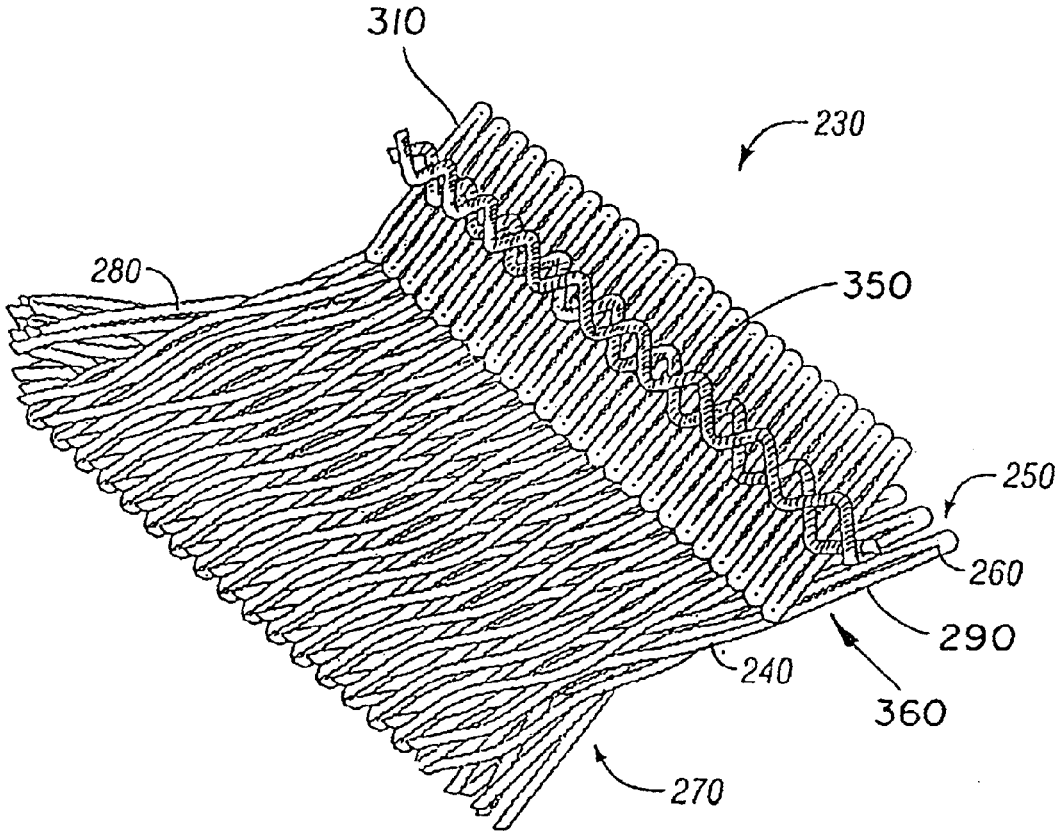
FIG. 6.

Another embodiment of the invention is shown in FIG. 6 where the decorative trim 230 does not have knotted tufts. The threads 240 that make up the decorative lip 250 are first arranged in parallel along their length. The threads 240 are then folded so that one thread is nested inside another with the shafts of the threads 240 lying side by side forming a relatively flat braid. The threads 240 are then repeatedly folded with the shafts of the threads lying roughly parallel and side by side. The overall length of the decorative lip 250 that is desired determines the distance between each fold 260.

The tassel portions 270 of the decorative trim are made by first arranging threads 280 in parallel along their length. The threads 280 are then folded so that one thread is nested inside another with the shafts of the threads lying side by side. The folded ends 290 of the tassel portions 270 are interspaced between the folds 260 of the decorative lip 250. The decorative lip 250 and the tassels portions 270 are stitched together by a cross stitching (not shown) similar to the stitching 150 of the embodiment illustrated in FIG. 1. Preferably, a plurality of cross stitches made of monofilament stitching are used to create the decorative lip 250 so that the folds 260 of the lip 250 act together to form one total discrete piece. However threads of different colors can also be used to stitch the decorative lip 250 together depending up the desired aesthetic effect. A greater number of cross stitching is used when a larger lip is created so that the threads within the lip will function as one discrete piece.

A decorative attachable lip 310 similar in construction to the attached lip 50 is attached to the decorative lip 250 by way of a cross stitching (not shown) similar to the stitching 200 connecting the attached lip 50 to the decorative lip 40.

Figure 7:
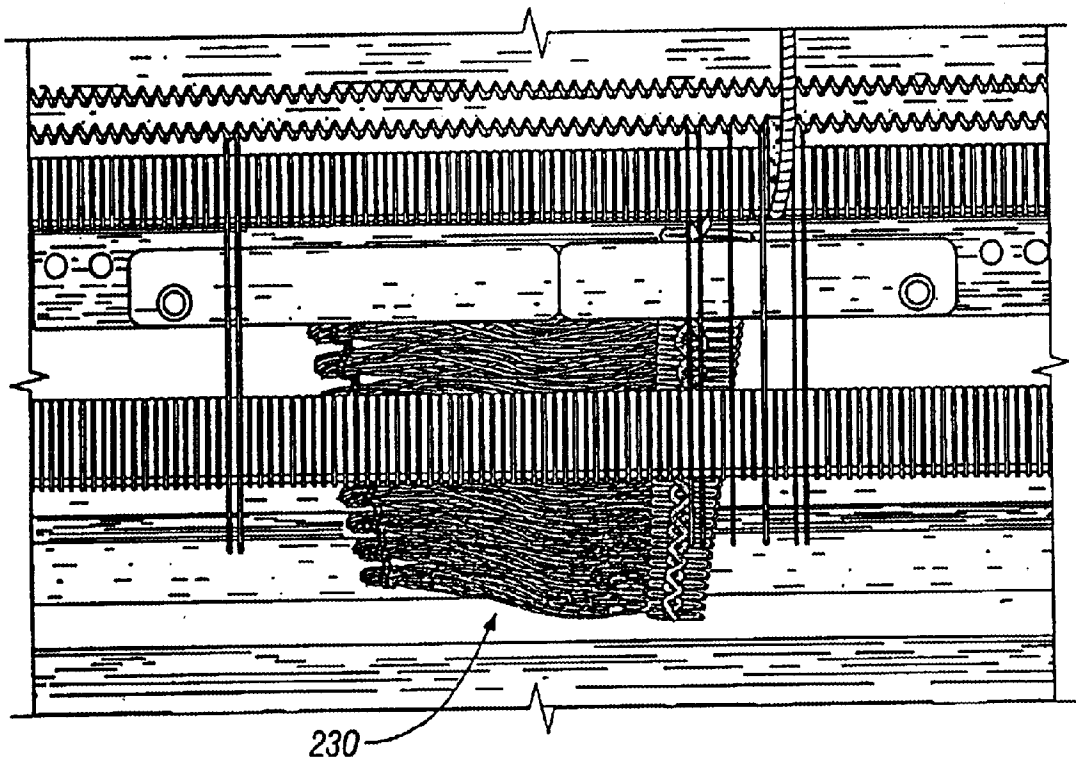
FIG. 7.
Figure 8:
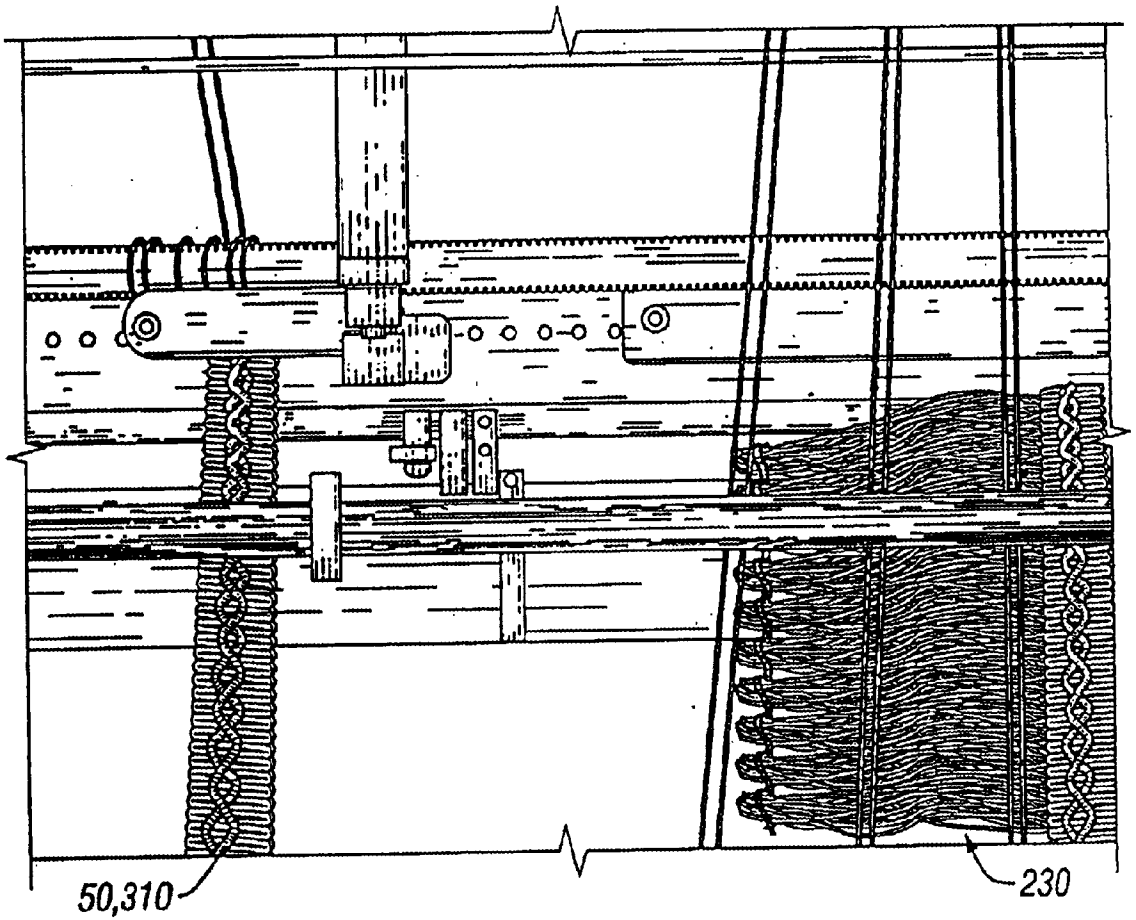
FIG. 8.

The claimed invention also includes a method of making a textile trim with decorative double lipped fastening structure as shown in FIGS. 7–9. The decorative trim 230 shown in FIGS. 7 and 8 are manufactured using a Decortronic model crocheting machine made by Comez of Italy. The crocheting machine is setup so that it creates the knotted tufts 30, 130 and the attached lip simultaneously, ensuring that the appearance of the decorative lip 250 and the attached lip 310 are the same. FIG. 9 illustrates how the decorative lip and attached lip are made on the Decortronic.

The concept of making the decorative lip 250 and the attached lip 310 simultaneously so that they may be joined together to form a double lipped article to be applied on opposite outer faces of an item is a new method of manufacture. Previously, single lipped decorative trim and trim known as gimps have been made separately for different applications. However, the claimed method entails simultaneously creating the decorative trim 250 and the attached lip 310 with the idea in mind of stitching the two items together forming a double lipped decorative trim 10, 230. With this thought in mind, the outer faces of the decorative trim 330, 340, 350, and 360 and the attached lip 310 are stitched with decorative design.

Previously, decorative trim was manufactured with a single lip so that it could be attached to an item by placing the single lip between two pieces of material. A common example of this type of attachment is typically shown in a pillow with decorative trim. Pillows of this type are commonly made by placing the single lip between the edges of the two pieces of material making the faces of the pillow so as to hide the connecting structure on the decorative trim.

With the creation of the double lipped decorative trim design, it is now possible to connect the lips on the outer surfaces of an item so that the connecting structures themselves add to the aesthetic presentation of the item. This is achieved by manufacturing the attached lip simultaneously so that the lips may be displayed as part of the overall appearance of an item.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A textile trim with decorative double lipped fastening structure, the trim comprising:

a first set of textile threads substantially parallel along their length folded near a mid point of the threads and knotted together providing a first knot near a mid point of the folded threads with a fringe end and a folded end on opposite sides of the first knot;

a second set of textile threads substantially parallel along their length adjacent the first set of threads, the second set folded near a mid point of the second set of threads and knotted together providing a second knot near a mid point of the second set of folded threads with a second fringe end and a second folded end on opposite sides of the second knot;

a first lip having a cross stitching substantially perpendicular to the first and second set of threads connecting the folded ends of the first and second set of threads side by side;

a second lip of thread having a plurality of folds folded to length substantially equal to the length of the folded ends of the first and second set of threads held together by a second cross stitching; and a third cross stitching securing the second lip adjacent the first and second knots providing a bottom of a fastening channel of uniform depth having decorative lips.

2. The trim of claim 1 wherein the bottom of the fastening channel provides a uniform stopping point for placement of an edge of a piece of material within the fastening channel so that the first and second lips protrude substantially equally on either side of the material.

3. The trim of claim 2 wherein each of the folds of the folded ends of the first and second set of threads have an apex and the cross stitching holds the apexes together.

4. The trim of claim 3 wherein the cross stitching is made of transparent plastic.

5. The trim of claim 4 wherein each of the folds of the second lip have an apex and further comprises a fourth cross stitching connecting the apexes of the second lip.

6. The trim of claim 5 wherein the third and fourth cross stitching are made of transparent plastic.

7. The trim of claim 6 wherein the knots of the first and second set of threads each have a cross over portion oriented to face a common direction.

8. The trim of claim 7 wherein the threads of the first and second set of threads are at least two different colors.

9. A trim piece comprising a U shaped fastening structure fastenable about at least one edge of at least one piece of material adjacent a knot, the knot defined by a plurality of textile threads having a predetermined thickness, the U shaped fastening structure having first and second legs, the first leg having a portion of the textile threads extending out of the knot, the second leg being constructed of textile material, and cross stitching adjacent the knot connecting the first and second legs.

10. The trim piece of claim 9 wherein the first leg is comprised of at least two of the plurality of threads, at least two of the plurality of threads being folded at a common folding point where a long axis of each of the threads are substantially parallel and are in a substantially common plane.

11. The trim of claim 9 wherein the portion of the threads forming the first leg are arranged and connected substantially side by side.

12. The trim of claim 10 wherein the first leg has a thickness substantially equal to twice the thickness of the textile threads.

13. The trim of claim 12 wherein the second leg is made of thread, the thread having a thickness substantially equal to the thickness of the textile threads and a length substantially equal to the first leg.

14. The trim of claim 13 wherein the cross stitching is made of transparent plastic.

15. The trim of claim 14 where the threads are at least two different colors.

16. A textile trim with decorative double lipped fastening structure, the trim comprising:

a first set of textile threads knotted together to provide a first knot near a mid point, a first fringe end and a first connecting end being located on opposite sides of the first knot;

a second set of textile threads adjacent the first set of threads knotted together providing a second knot near a mid point of the second set of threads, a second fringe end and a second connecting end being located on opposite sides of the second knot;

a first lip formed by connecting the first connecting end to the second connecting end; and a second lip of textile material having a fastened end fastened to the first and second connecting ends adjacent the first and second knots.

17. The trim of claim 16 wherein the first and second lip define a fastening channel, a bottom portion of the fastening channel providing a stopping point for placement of an edge of a piece of material within the fastening channel.

18. A textile trim with decorative double lipped fastening structure, the trim comprising:

a first substantially flat lip of thread having a plurality of folds, the folds being arranged side by side;

at least one first cross stitching holding the folds in side by side relationship;

at least one tassel having at least one thread folded near a mid point forming a folded end and a fringe end, the folded end lying between folds of the first lip;

at least one second cross stitching connecting the folded end of the tassel to the first lip;

a second lip of thread having a plurality of folds folded to length substantially equal to the first lip where the folds are arranged side by side so that the lip is substantially flat;

at least one third cross stitching connecting an edge of the second lip parallel with an edge of the first lip forming a connecting pocket between the first lip and the second lip for inserting at least one piece of material.

19. The trim of claim 18 wherein the connecting pocket has a uniform stopping point for placement of an edge of the piece of material within the connecting pocket so that the first and second lips protrude substantially equally on either side of the material.

20. The trim of claim 19 wherein the first cross stitching, the second cross stitching and the third cross stitching are made of transparent plastic.

21. A method of making a textile trim article with decorative double lipped fastening structure, the method comprising:

cutting lengths of thread to a predetermined length within a predetermined tolerance;

arranging at least one first length of thread with at least one second length of thread so that a long axis of the first length is substantially parallel with a long axis of the second length;

folding the first and second lengths at a common predetermined point forming a folded end and a fringe end so that portions of the lengths on each side of the fold are parallel with each other;

knotting the first and second lengths into a knotted tuft where the folded end and the fringe end are on opposite side of the knot;

arranging a first knotted tuft side by side with a second knotted tuft;

connecting the first and second knotted tufts together at the folded end;

securing outer ends of the folded ends preventing unraveling of the tufts;

folding at least one third length of thread to a predetermined folded length a plurality of times so that the folded lengths lie side by side;

stitching the folded lengths together with a cross stitch forming a textile lip; and fastening an edge of the textile lip to the folded ends.

22. The method of claim 21 further comprising arranging the edge of the textile lip parallel to the knotted tuft before fastening the edge to the folded ends.

23. The method of claim 22 further comprising determining the predetermined folded length of the third length of thread by measuring the length of the folded end of the first and second lengths of thread.

24. A method of making a textile trim article with decorative double lipped fastening structure, the method comprising:

using a single automatic crocheting machine to create a single lip decorative trim having a plurality of knots while simultaneously making an attachment lip structure for attachment to the single lip decorative trim so that the aesthetic appearance of the attachment lip substantially matches the aesthetic appearance of the single lip;

aligning an edge of the attachment lip structure parallel to the single lip of the decorative trim; and connecting the edge of the attachment lip structure to the single lip decorative trim adjacent and parallel to the knots of the decorative trim.

25. A method of making a textile trim article with decorative double lipped fastening structure, the method comprising:

using a single automatic crocheting machine to create a single lip decorative trim while simultaneously making an attachment lip structure for attachment to the single lip decorative trim so that the aesthetic appearance of the attachment lip substantially matches the aesthetic appearance of the single lip;

aligning an edge of the attachment lip structure parallel to the single lip of the decorative trim; and connecting the edge of the attachment lip structure to the single lip decorative trim adjacent and parallel to an edge of the single lip.

* * * * *